US005653301A

United States Patent [19]

André

[11] Patent Number: 5,653,301

[45] Date of Patent: Aug. 5, 1997

[54] WHEEL-SUPPORTED APPARATUS FOR CLIMBING AND DESCENDING STAIRS

[76] Inventor: Émile Robert André, 705, rue Pagé, Prévost Québec, Canada, J0R 1T0

[21] Appl. No.: 504,321

[22] Filed: Jul. 19, 1995

[30] Foreign Application Priority Data

Aug. 2, 1994 [CA] Canada ..... 2129316

[51] Int. Cl.[6] ..... A61G 5/02

[52] U.S. Cl. ..... 180/8.2; 180/8.5; 280/5.2; 280/DIG. 10

[58] Field of Search ..... 280/5.2, 5.26, 280/5.28, 5.3, DIG. 10; 180/8.1, 8.2, 8.5

[56] References Cited

U.S. PATENT DOCUMENTS

| | | | |
|---|---|---|---|
| 468,022 | 2/1892 | Bray . | |
| 3,227,465 | 1/1966 | Massie | 280/5.2 |
| 3,438,641 | 4/1969 | Bradley | 280/5.28 |
| 3,592,282 | 7/1971 | Soileau | 180/8 A |
| 4,618,155 | 10/1986 | Jayne | 280/5.28 |

FOREIGN PATENT DOCUMENTS

| | | | |
|---|---|---|---|
| 1194775 | 10/1958 | Canada . | |
| 1261726 | 9/1989 | Canada . | |
| 1275296 | 10/1990 | Canada . | |
| 1283668 | 4/1991 | Canada . | |
| 1298586 | 4/1992 | Canada . | |
| 1313891 | 2/1993 | Canada . | |
| 60-206791 | 10/1985 | Japan | 180/8.5 |
| 6-170756 | 6/1994 | Japan | 180/8.3 |
| 1069810 | 1/1984 | U.S.S.R. | 180/8.2 |

*Primary Examiner*—Victor E. Johnson
*Attorney, Agent, or Firm*—Darby & Darby

[57] ABSTRACT

The wheel-supported apparatus is used for climbing and descending stairs. The apparatus comprises a hollow main frame. A first carriage unit is located within the main frame and is slidably connected thereto. The first carriage unit is horizontally movable between a maximum front position and a maximum rear position by a first screw mechanism. A second carriage unit is slidably interconnected with the first carriage unit and is provided with a lower ground-engaging portion. The second carriage unit is movable vertically between a fully retracted position and a fully extended position by a second screw mechanism. The first and second screw mechanisms are operated in sequence for rising and backing the apparatus during climbing, and lowering and moving forward the apparatus during descent. Extendable supporting legs are used with a pair of rear caster wheels operatively connected under the main frame for periodically supporting the apparatus when climbing and descending the stairs. The apparatus is particularly suitable for use as a wheelchair for a handicapped person or for transporting merchandises up and down a stairway.

8 Claims, 7 Drawing Sheets

WHEEL-SUPPORTED APPARATUS FOR CLIMBING AND DESCENDING STAIRS

FIELD OF THE INVENTION

The present invention relates to a wheel-supported apparatus for climbing and descending stairs, which is particularly suitable for use as a wheelchair for a handicapped person or for transporting merchandises up and down a stairway.

BACKGROUND OF THE INVENTION

Over the years, many stair climbing apparatuses that climb and descend stairs on their own have been developed, especially for use with or as wheelchairs. Some of them use tracks, like in Canadian patents Nos. 1,194,775 issued on 8 Oct. 1985, 1,283,668 issued on 30 Apr. 1991, and 1,298,586 issued on 7 Apr. 1992. Others use a plurality of wheels, like in U.S. Pat. No. 3,438,641 issued on 15 Apr. 1969, and U.S. Pat. No. 3,592,282 issued on 13 Jul. 1971, and Canadian patents Nos. 1,261,726 issued on 26 Sep. 1989, 1,275,296 issued on 16 Oct. 1990, and 1,313,891 issued on 23 Feb. 1993. Other examples of stair-climbing and descending mechanisms are disclosed in U.S. Pat. No. 3,227,465 issued on 4 Jan. 1966 and U.S. Pat. No. 4,618,155 issued on 21 Oct. 1986.

Also known in the art is U.S. Pat. No. 468,022 (Bray) issued on 2 Feb. 1892 and relating to a stair-climbing perambulating chair. Bray discloses a chair comprising screws to lift the chair vertically and a rack-and-pinion arrangement to advance the chair horizontally. However, one drawback of Bray is that the mechanism is so bulky and cumbersome that it is on the sides of the chair, thereby resulting in a chair wider than conventional.

SUMMARY OF THE INVENTION

The object of the present invention is to provide a very compact and practical wheel-supported apparatus for climbing and descending stairs, which is particularly suitable for use as a wheelchair for a handicapped person or for transporting merchandises up and down a stairway.

More particularly, the object of the present invention is to provide a wheel-supported apparatus for climbing and descending stairs, the apparatus having first and second carriage units that are slidably interconnected with respect to each other. Each carriage unit has an associated actuating means which independently moves its respective carriage unit, as controlled by control means associated with the apparatus. Preferably, one carriage unit is moved horizontally and the other is moved vertically. The carriages are moved sequentially to ascend or descend a staircase. The apparatus also includes supporting means for periodically supporting the apparatus when the vertically movable unit is raised during ascent or descent of a staircase.

A non restrictive description of a preferred embodiment will now be given with reference to the appended drawings.

DESCRIPTION OF A PREFERRED EMBODIMENT

Figure 1:
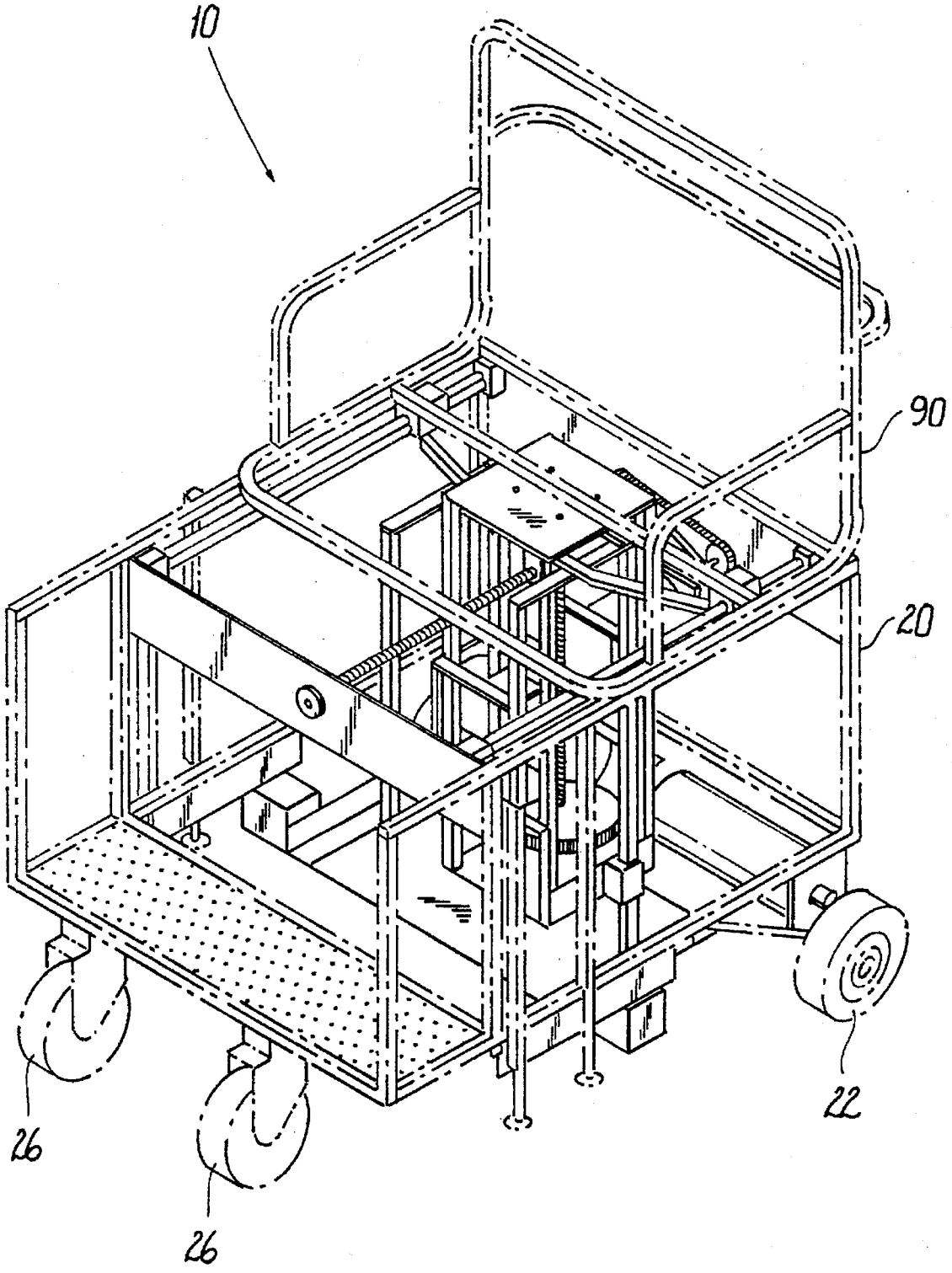
FIG. 1 is a perspective view of the apparatus according to the present invention, shown without the protective panels.
Figure 2:
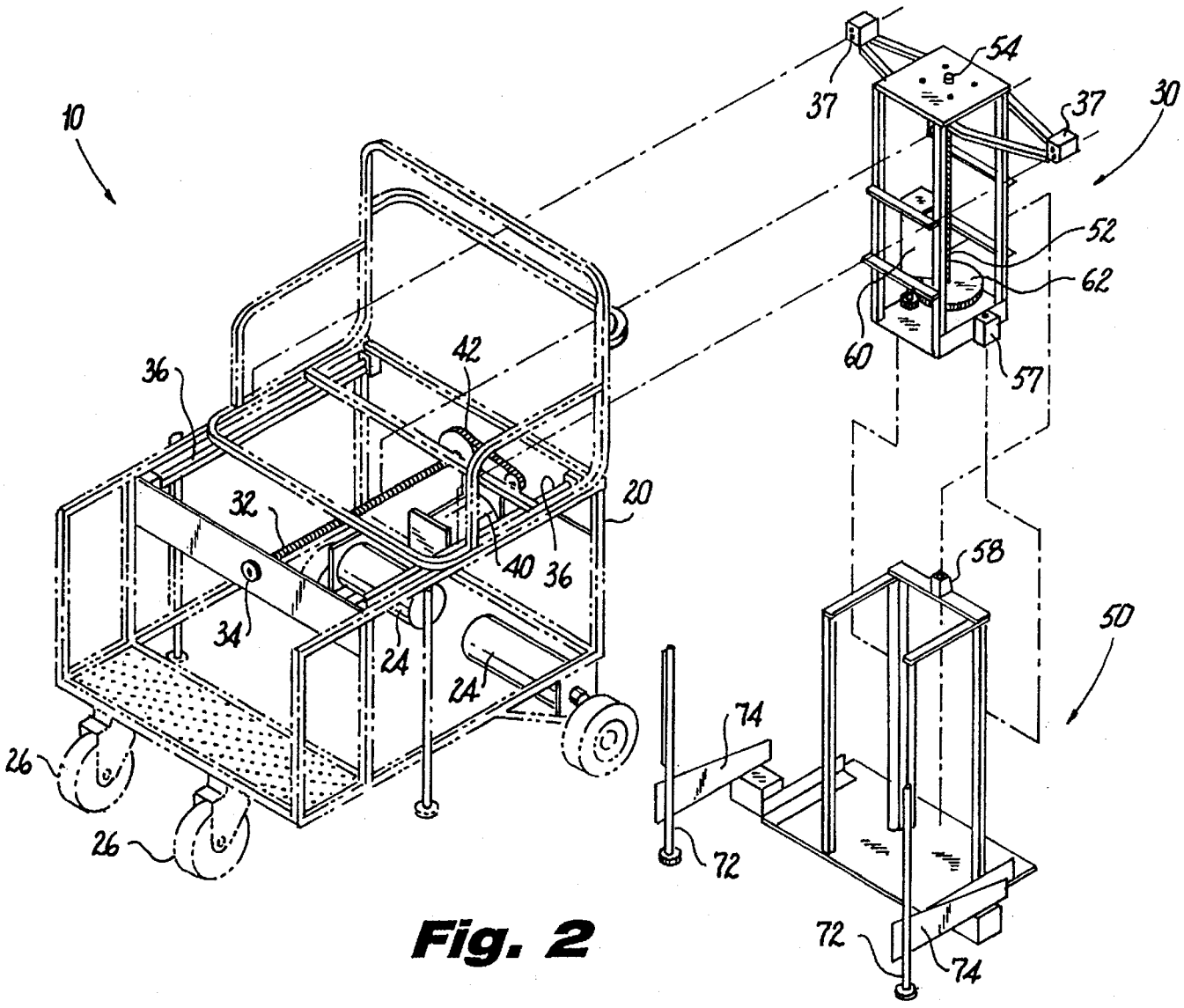
FIG. 2 is an exploded perspective view of the apparatus of FIG. 1.
Figure 3:
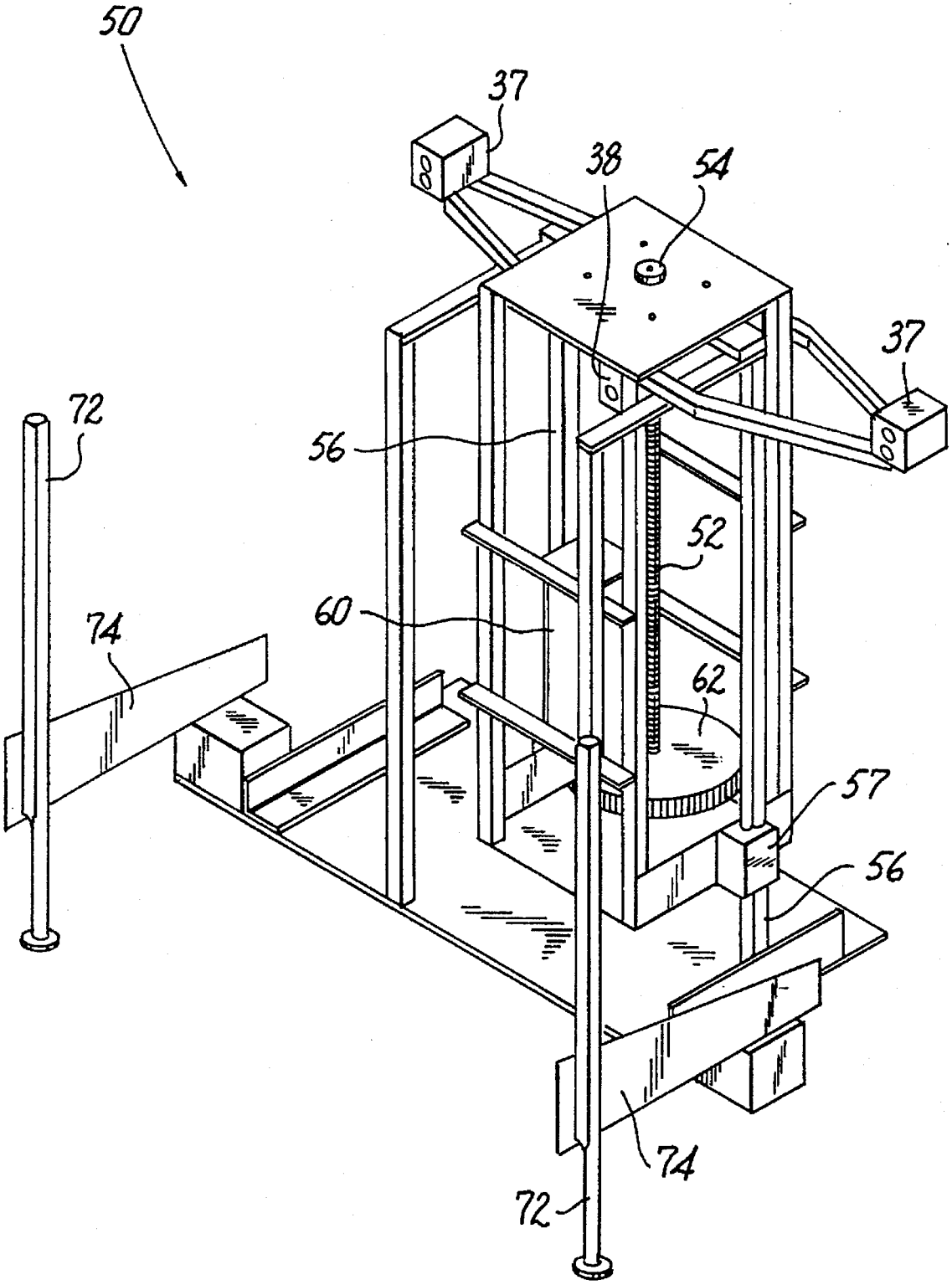
FIG. 3 is an enlarged view of the first and second carriage units of the apparatus shown in FIG. 1.

Referring in detail to the drawings, there is shown a wheel-supported apparatus (10) for climbing and descending stairs (16). Although the preferred embodiment illustrated in drawings has a seat (90) for accommodating a handicapped person, which then allows the apparatus (10) to be used as a wheelchair, the apparatus (10) may be very suitable for transporting merchandises up and down the stairs (16) when provided with an appropriate storage area, as apparent to a person skilled in the art.

The apparatus (10) comprises a hollow main frame (20) preferably made of metal bars to form a suitable structure. The main frame (20) is said to be hollow because it is housing some movable parts, as explained hereinafter. The sides of the main frame (20) are normally covered by protective panels (not shown). It is important that the rear panel do not interfere with the rear caster wheels (22) or the stairs (16). For that reason, the rear bottom of the apparatus (10) is usually provided with a recess.

The main frame (20) comprises caster wheels (22,26) operatively connected thereunder so that the apparatus (10) can move on a travel surface, such as a street or the floor of a building, for instance. However, the front caster wheels (26) may be replaced by a single wheel or a pair of wheels having a much greater diameter. In the illustrated preferred embodiment, the front caster wheels (26) are free to rotate around a pivot axis and the rear caster wheels (22) remain in the same direction.

Preferably, the rear caster wheels (22) are powered by driving means such as the independent electric motors (24). This allows the apparatus (10) to be self-propelled for moving of a travel surface, such as the ground level (14). A suitable control, comprising for instance a joystick (84), is used for controlling the electric motors (24). The electric motors (24) are powered by a suitable power source, such as a battery.

The apparatus (10) comprises a first carriage unit (30) located within the main frame (20) and slidably connected thereto by means of first support shafts (36), such as the ones manufactured under the trade name Thomson, on which slide sliding members (37) located at the end of side supports. The first carriage unit (30) is horizontally movable anywhere between a maximum front position and a maximum rear position.

A first actuating means is provided for moving the first carriage unit (30). The first actuating means preferably comprises a first screw (32) which is horizontally disposed and operatively connected within the main frame (20) by first end bearings (34). The first screw (32) is in mesh with a first nut element (38) rigidly connected to the first carriage unit (30). For moving the first carriage unit (30), the first screw (32) is driven in rotation by a first electric motor (40) rigidly connected to the main frame (20). A set of gears (42) are used for increasing the torque and for mechanically connecting the first electric motor (40) with the first screw (32).

A second carriage unit (50) is slidably interconnected with the first carriage unit (30) by means of second support shafts (56), similar to the first support shafts (36), on which slide corresponding sliding members (57). The second carriage unit (50) is movable vertically anywhere between a fully retracted position and a fully extended position.

A second actuating means is provided for moving the second carriage unit (50) relative to the first carriage unit (30). The second actuating means preferably comprises a second screw (52) which is vertically disposed in the median plane of the apparatus (10) and operatively connected within the first carriage unit (30) by second end bearings (54). The second screw (52) is in mesh with a second nut element (58) rigidly connected to the second carriage unit (50). For moving the second carriage unit (50), the second screw (52) is driven in rotation by a second electric motor (60) rigidly connected to the first carriage unit (30). A set of gears (62) is used for increasing the torque and for mechanically connecting the second electric motor (60) with the second screw (52). The second carriage unit (50) is provided with a lower ground-engaging portion (66), preferably comprising a substantially flat and horizontal plate with a non-slip surface for periodically contacting the ground or the stairs (16) during climbs and descents.

Figure 9:
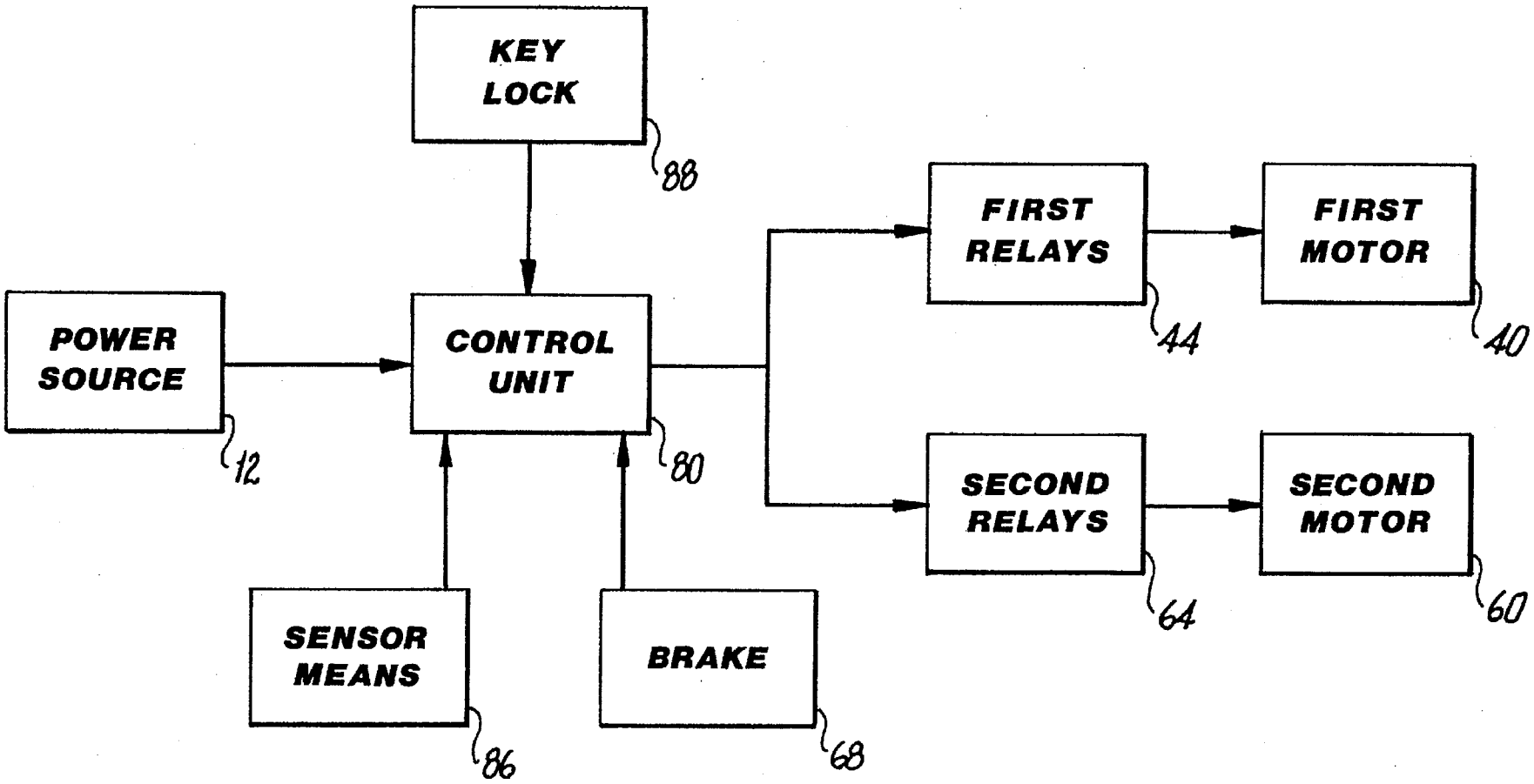
FIG. 9 is a block diagram showing an example of the electrical connections in the apparatus according to the present invention.

A control unit (80), schematically illustrated in FIG. 9, controls the operation of the first electric motor (40) through first relays (44), and of the second electric motor (60) through second relays (64). The control unit (80) is responsive of the commands sent by the user through, for example, the climb/descend controls (82). Operation of the apparatus (10) is described in details further in the text. A key lock (88), schematically shown in FIG. 9, may be provided for preventing use of the apparatus (10) by unauthorized persons.

As aforesaid, the purpose of the present apparatus (10) is to climb and descend stairs (16). To do so, the apparatus (10) is designed to lift and move backward in sequence when climbing the stairs (16), and to lower and move forward in sequence when descending the stairs (16). This is done with the use of the first and second carriage units (30,50).

FIGS. 4 to 8 show the succession of steps performed by the apparatus (10) to climb the stairs (16). The descent follows the same steps but in a reversed order. Although the present description and the claims of the invention refer to the rear side of the apparatus (10) as the side facing the stairs (16), it should be understood that the position of the seat (90) shown in the drawings can be reversed, the front side and the rear side then being inverted.

Figure 4:
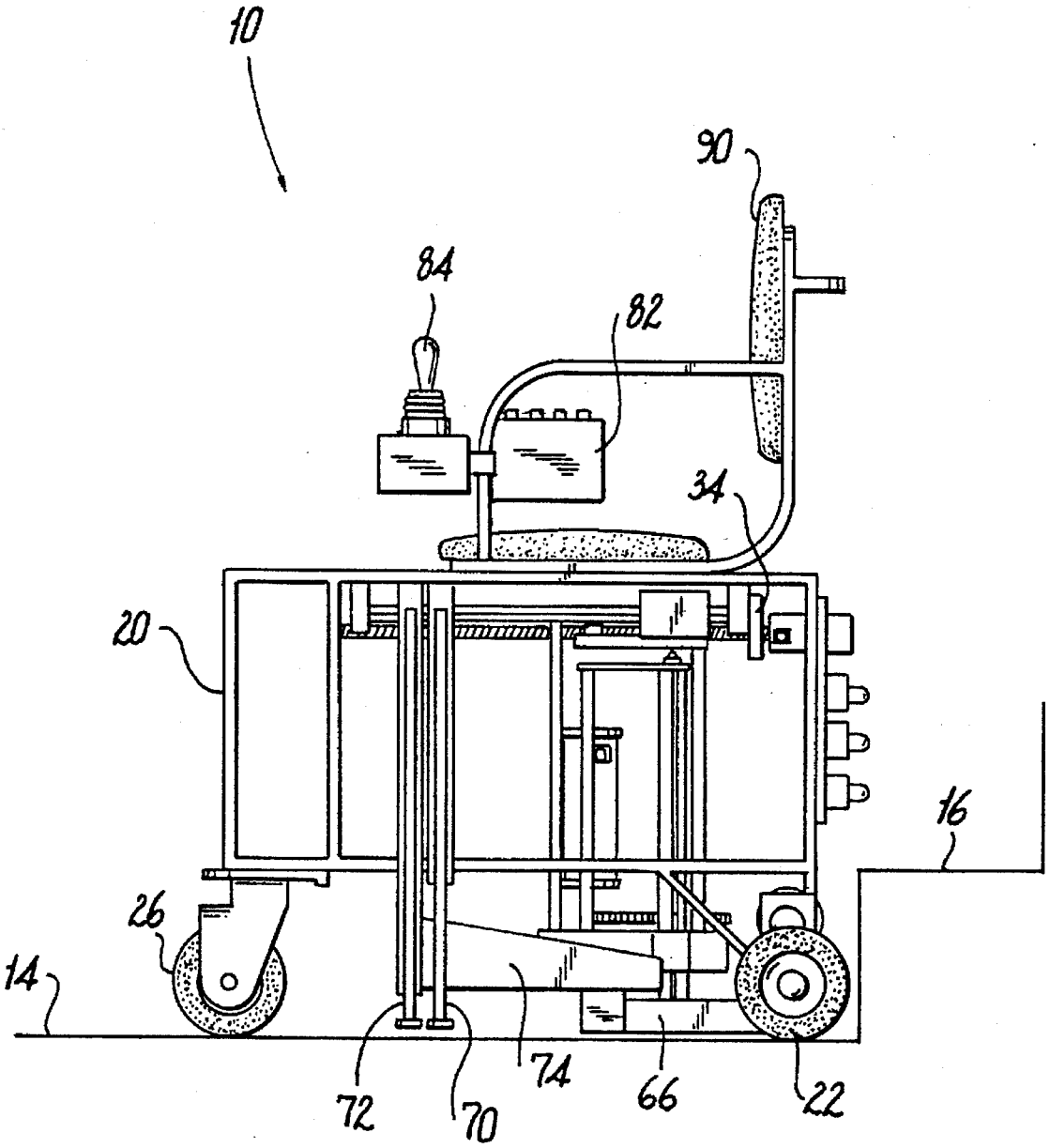
FIG. 4 is a side elevational view of the apparatus of FIG. 1 and illustrating the apparatus at the bottom of a stairway.

Referring to FIG. 4, the apparatus (10), currently lying on ground level (14), is backed against or close to the first stair (16). The first step is the lifting of the main frame (20), and of course of the other connected element, by moving the second carriage unit (50) relative to the first one. Before doing so, the first carriage unit (30) is positioned at the maximum or near the maximum rear position, if not already in position.

Figure 5:
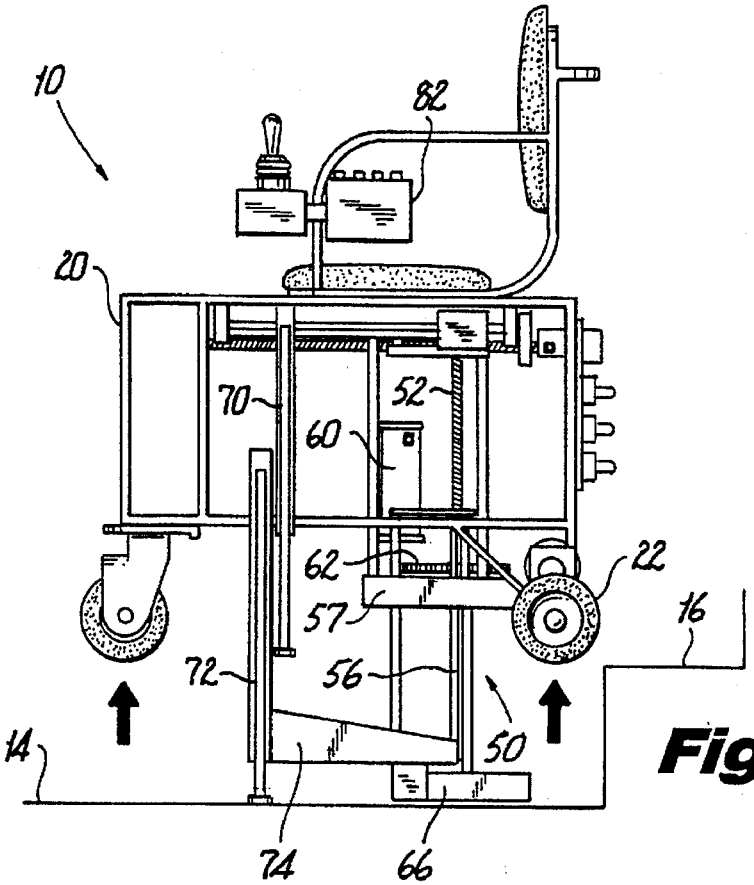
FIG. 5 is a view similar to FIG. 4, illustrating the lifting of the main frame.

FIG. 5 shows the lifting of the apparatus (10) by activating the second electric motor (60), which then rotates the second screw (52). The second carriage unit (50) is moved from the fully or near fully retracted position to an extended position where the rear caster wheels (22) are substantially aligned with a next stair (16).

The apparatus (10) is provided with two extendable supporting means. The first extendable supporting means is attached to the main frame (20) and is used for periodically supporting the apparatus (10) with the rear caster wheels (22). Preferably, the first supporting means comprises a pair of first extendable legs (70), each connected along a respective side of the main frame (20). The first extendable legs (70) are movable and lockable between a retracted position, used for storage, and an adjustable extended position. They may be either extended by hand, or either further comprising a means for automatically extending and retracting them. The purpose of the first extendable legs (70) is to periodically support the apparatus (10) with the rear caster wheels (22) during the time the apparatus (10) is not supported by the second carriage unit (50), like in FIG. 7.

Figure 6:
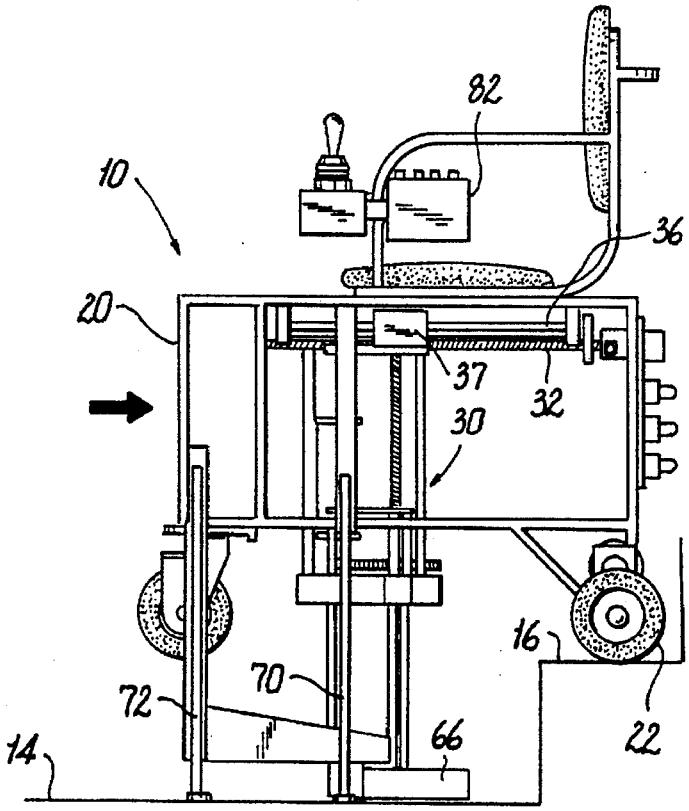
FIG. 6 is a view similar to FIG. 4, illustrating the backing of the main frame following the lift thereof in FIG. 5.

The second screw (52) is preferably self-locking to prevent unintentional lowering of the main frame (20) when in a position like in FIG. 6. If not, or in order to add to the safety, the second carriage unit (50) may comprise a brake mechanism (68), schematically shown in FIG. 9, activated by the control unit (80) and used to lock the second screw (52). Various embodiments for the brake mechanism (68) are possible, as apparent to a person skilled in the art.

The second extendable supporting means is attached in front of the second carriage unit (50) and is used for periodically supporting the apparatus (10) with the second carriage unit (50) when climbing and descending the stairs (16). Preferably, the second supporting means comprises a pair of second extendable legs (72), each connected along a respective side in front of the second carriage unit (50). Like the first extendable legs (70), the second extendable legs (72) are movable and lockable between a retracted position, used for storage, and an adjustable extended position. They may be either extended by hand, or either further comprising a means for automatically extending and retracting them. The second extendable legs (72) are said to be in front of the second carriage unit (50) to support the front of the apparatus (10) and prevent it from toppling. Connecting members (74) are used for linking the second extendable legs (72) to the second carriage unit (50), thus allowing them to follow the movements of the second carriage unit (50).

In FIG. 5, the second extendable legs (72) where set to contact the ground level (14) prior to the lifting of the main frame (20).

Referring now to FIG. 6, the main frame (20) is backed until the rear caster wheels (22) are against or close to the next stair (16). To do so, the first electric motor (40) is activated for rotating the first screw (32) in the appropriate direction. One of the advantages of the present invention is that the rear caster wheels (22) will then roll on the next stair (16) as the main frame (20) moves back. This thus improves the safety of the apparatus (10) because the apparatus (10) is prevented from toppling.

Figure 7:
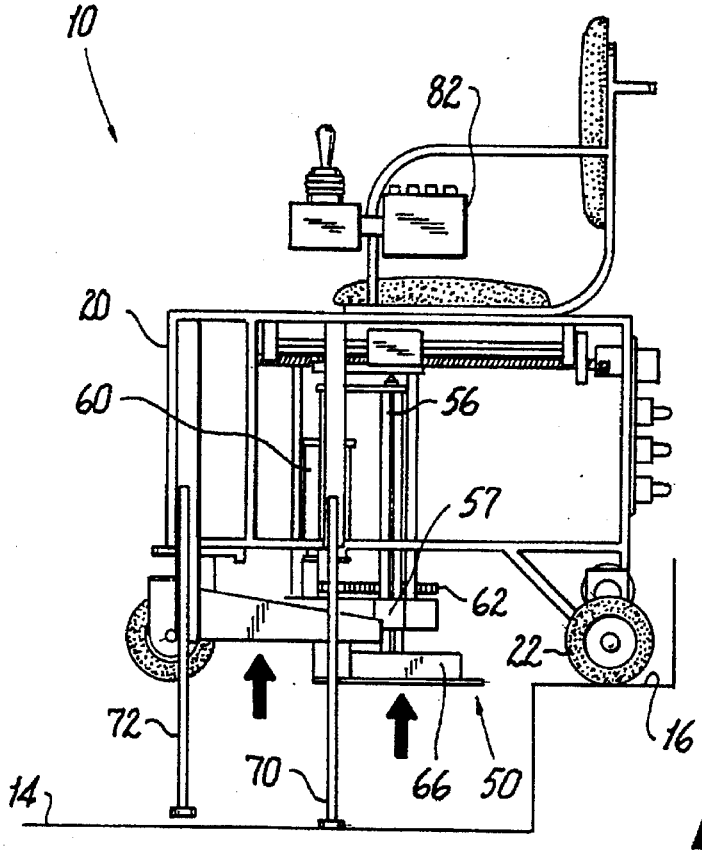
FIG. 7 is a view similar to FIG. 4, illustrating the lifting of the second carriage unit following the backing of the main frame in FIG. 6.

In FIG. 7, the second carriage unit (50) is lifted up upon activation of the second electric motor (60), which rotates the second screw (52) until it clears the next stair (16). The second carriage unit (50) is then moved from the extended position towards the retracted position. The second extendable legs (72) are extended downward and locked in that position afterwards for climbing the other stairs.

Figure 8:
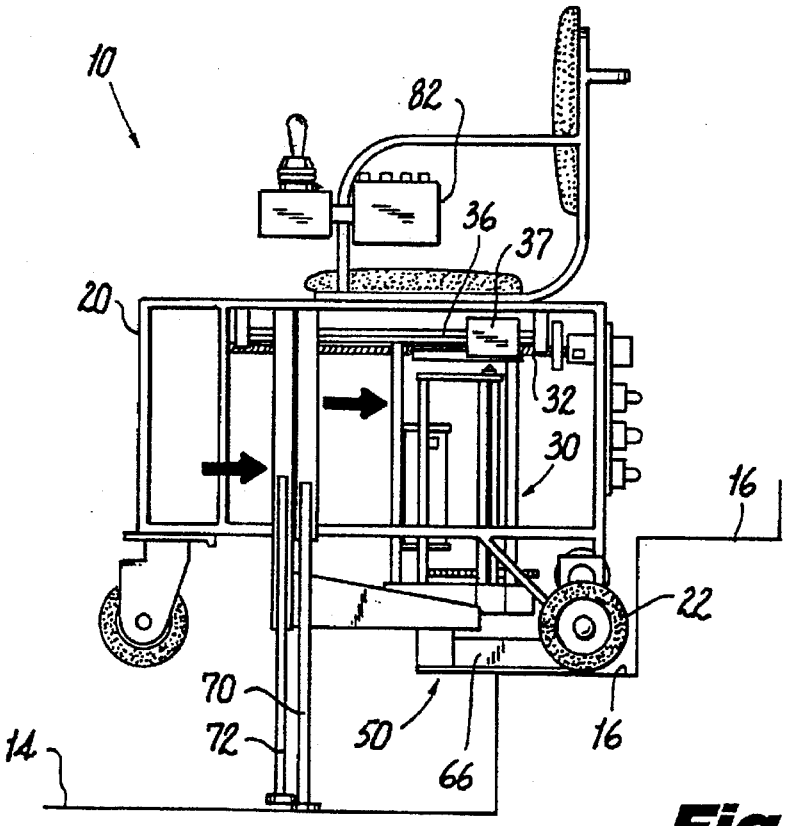
FIG. 8 is a view similar to FIG. 4, illustrating the repositioning of the first and second carriage units on the next stair.

In FIG. 8, the first and the second carriage units (30,50) are moved backwards until properly positioned over the next stair (16). To do so, the first electric motor (40) is activated for rotating the first screw (32) and moving the first and second carriage units (30,50) towards the rear. The other stairs (16)-are climbed the same way.

According to a preferred embodiment, the apparatus (10) comprises sensor means (86), such as limit switches or optical detectors set at the front and the rear of the main frame (20). Such sensor means (86) may be used for automatically detecting the height of each stair (16) and assisting the user in the operation of the apparatus (10). For example, the height of the stairs of buses may vary, depending on the model and the height of the sidewalks. The sensor means (86) can then be used for automatically actuating the first and second electric motors (40,60) for speeding up the climb or the descent. It may also be used for actuating means for automatically extending or retracting the extendable legs (70,72), if provided.

Although a preferred embodiment of the invention has been described in detail herein and illustrated in the accompanying drawings, it is to be understood that the invention is not limited to this precise embodiment and that various changes and modifications may be effected therein without departing from the scope or spirit of the invention.

What is claimed is:

1. A wheel-supported apparatus for climbing and descending stairs, the apparatus comprising:

a hollow main frame, the main frame comprising a pair of rear caster wheels operatively connected under the main frame;

a first carriage unit located within the main frame and slidably connected thereto, the first carriage unit being movable horizontally;

a first actuating means for moving the first carriage unit;

a second carriage unit slidably interconnected with the first carriage unit and provided with a lower ground-engaging portion, the second carriage unit being movable vertically;

a second actuating means for moving the second carriage unit;

a first extendable supporting means attached to the main frame for periodically supporting the apparatus with the rear caster wheels when climbing and descending the stairs;

a second supporting means attached to a front of the second carriage unit for periodically supporting the apparatus with the second carriage unit when climbing and descending the stairs; and a control means for controlling the first and second actuating means.

2. A wheel-supported apparatus according to claim 1, further comprising a seat for accommodating a handicapped person.

3. A wheel-supported apparatus according to claim 1, wherein the first actuating means comprises a first screw which is horizontally disposed and operatively connected within the main frame, the first screw being in mesh with a first nut element rigidly connected to the first carriage unit and being driven in rotation by a first electric motor rigidly connected to the main frame for moving the first carriage unit.

4. A wheel-supported apparatus according to claim 1, wherein the second actuating means comprises a second screw which is vertically disposed and operatively connected within the first carriage unit, the second screw being in mesh with a second nut element rigidly connected to the second carriage unit and being driven in rotation by a second electric motor rigidly connected to the first carriage unit for moving the second carriage unit.

5. A wheel-supported apparatus according to claim 1, wherein the first extendable supporting means comprises a pair of first extendable legs, each connected to a respective side of the main frame.

6. A wheel-supported apparatus according to claim 1, wherein the second extendable supporting means comprises a pair of second extendable legs, each connected to a respective side in front of the second carriage unit.

7. A wheel-supported apparatus according to claim 2, wherein the rear caster wheels further comprise driving means for moving the apparatus on a travel surface, the control means further controlling the driving means.

8. A wheel-supported apparatus according to claim 1, wherein the lower ground-engaging portion of the second carriage unit comprises a substantially flat and horizontal plate provided with a non-slip surface.

* * * * *